US009884429B2

(12) United States Patent
Payne

(10) Patent No.: US 9,884,429 B2
(45) Date of Patent: Feb. 6, 2018

(54) BAND CUTTER

(71) Applicant: Ben Payne, Lower Hutt (NZ)

(72) Inventor: Ben Payne, Lower Hutt (NZ)

( * ) Notice: Subject to any disclaimer, the term of this patent is extended or adjusted under 35 U.S.C. 154(b) by 192 days.

(21) Appl. No.: 14/827,359

(22) Filed: Aug. 17, 2015

(65) Prior Publication Data

US 2016/0052152 A1 Feb. 25, 2016

(51) Int. Cl.
*B26B 29/00* (2006.01)
*B26B 3/00* (2006.01)
*B26B 29/06* (2006.01)

(52) U.S. Cl.
CPC ..... *B26B 3/00* (2013.01); *B26B 29/06* (2013.01)

(58) Field of Classification Search
CPC ..... B26B 3/00; B26B 29/06; B23D 21/10; B23D 21/06; H02G 1/1229; H02G 1/1217; B23B 29/16; B25B 1/2452; B25B 1/103; B25B 1/241; B25B 1/2484; B25B 5/142; B25B 5/163; B25B 1/16; B25B 1/24
USPC ..... 30/286
See application file for complete search history.

(56) References Cited

U.S. PATENT DOCUMENTS 2,165,209 A * 7/1939 Baldanza ..... H02G 1/005 30/182
3,403,901 A * 10/1968 Servadio ..... B25B 5/101 269/243
3,833,210 A * 9/1974 Kotter ..... B25B 5/163 269/170
3,902,244 A 9/1975 McFarland et al.
3,946,487 A * 3/1976 Bieganski ..... H02G 1/1231 30/90.7
4,753,425 A * 6/1988 Yang ..... B25B 5/003 269/249
5,135,209 A * 8/1992 Penny ..... B25B 5/101 269/249
5,203,083 A 4/1993 Domonoske
D344,226 S * 2/1994 Glynn ..... D8/73
5,315,759 A * 5/1994 Mashata ..... B23D 21/08 30/101
5,419,046 A * 5/1995 Mayo, Jr. ..... B08B 1/00 15/236.07
5,829,142 A * 11/1998 Rieser ..... B23D 21/08 30/93
5,943,778 A * 8/1999 Alana ..... B23D 21/00 30/101

(Continued)

FOREIGN PATENT DOCUMENTS

JP H02250781 10/1990

OTHER PUBLICATIONS

NZ Intellectual Property Office First Examination Report and Patent Examination report No. 1.

*Primary Examiner* — Ghassem Alie
*Assistant Examiner* — Bharat C Patel
(74) *Attorney, Agent, or Firm* — Inventa Capital PLC

(57) ABSTRACT

A band cutter for removing bands or rings from tubing joints such as those on and associated with plumbing fittings, in particular where the band or ring has been used to secure plastic plumbing pipe or tubing over a fitting. The band cutter includes a main tool body defining an upper portion and a lower portion, a fixed jaw situated on the upper portion of main tool body, a moveable lower jaw independently slideably attachable to the main tool body and situated below the fixed jaw and above the lower portion.

12 Claims, 2 Drawing Sheets

(56) References Cited

U.S. PATENT DOCUMENTS 6,431,534 B1 * 8/2002 Orosz ..... B25B 5/101
269/249
6,463,654 B1 * 10/2002 Moore ..... H02G 1/1231
29/825
6,769,181 B1 8/2004 Scheuerman et al.

* cited by examiner

BAND CUTTER

RELATED APPLICATIONS

This application claims priority to New Zealand patent application No. 629038 filed Aug. 20, 2014, and incorporated herewith by reference in its entirety.

FIELD OF THE INVENTION

The invention relates to a Band Cutter for removing bands or rings from tubing joints such as those on and associated with plumbing fittings, in particular where the band or ring has been used to secure plastic plumbing pipe or tubing over a fitting.

BACKGROUND OF INVENTION

The introduction of plastic piping to the plumbing industry has achieved a significant saving of time. The piping used in plumbing is referred by a variety of terms such as hose, piping or tubing. Steel piping requires a labour and time intensive fitting and threading process. Rigid copper piping avoids the threading process but replaces it with the need for soldering. Plastic tubing requires less fitting and the resulting joints are easy to use and assemble. Tubing used for household plumbing is placed over a fitting's barbed or ribbed end and secured with a clamp of some sort. It is known to use bands or rings, such as annealed copper rings, over plastic plumbing tubing attached to a plumbing fitting's end to provide a sealed and secure joint. Since the tubing is resilient it is caused to deform over the contour of the fittings end thus preventing the tubing's removal therefrom.

On occasions it is necessary to change the connection at the joint such as to remove or replace the fitting. The fitting can be salvaged for reuse. However in order to be able to reuse the fitting the band or ring has to be removed. Such removal can be challenging and demanding. A hacksaw can be used to angle cut the ring from the tubing and the fitting. However this may result in damage to the fitting and not all fittings are in positions to which a hacksaw can always be easily used.

There are a number of tools used to hold and cut pipes or tubes, however, these pipe-cutters cut the pipe circumferentially. None of these tools could be used to remove a band or ring from a fitting without causing deformation or damage to the fitting. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications may be referred to herein; this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process. It is an object of the invention to provide a Band Cutter that ameliorates some of the disadvantages and limitations of the known art or at least provide the public with a useful choice.

SUMMARY OF INVENTION

In a first aspect the invention resides in a band cutter for removing bands or rings from tubing joints such as those on and associated with plumbing fittings, in particular where the band or ring has been used to secure plastic plumbing pipe or tubing over a fitting, the band cutter including: a main tool body defining an upper portion and a lower portion, a fixed jaw situated on the upper portion of main tool body, a moveable lower jaw slidably attachable to the main tool body and situated below the fixed jaw, the lower jaw adapted to support thereon a band of a banded plumbing fitting, a moving means adapted to move the lower jaw toward and away from the fixed jaw, and a cutting blade situated within and extending downwardly and outwardly from the fixed jaw in a direction toward the lower jaw, wherein the band cutter is adapted to clamp the band of the banded fitting between the jaws as the lower jaw is moved by the moving means toward the fixed jaw so that as the fitting and band is moved toward the fixed jaw the band is pressed against the blade until such time as the blade tangentially cuts through the band and then once the band is cut the moveable lower jaw is caused to move away from the fixed jaw by the moving means so as to allow fitting to be removed from the band cutter and thus allow the cut band to be removed from the fitting.

Preferably, the main tool body has a moving means guide situated at a lower portion of the main tool portion directly opposite and spaced apart to the fixed jaw such that the main tool body, fixed jaw and guide form a substantially c-shape in cross-section.

Preferably, the lower jaw is positioned such that the lower jaw is able slide up and down the main tool body within the opening of the c-shape.

Preferably, the lower jaw is releasably attached to main tool body.

Preferably, the lower jaw has a longitudinal slot dimensioned and sized so that the depth of the slot is slightly greater than the thickness of the main tool body and the depth of the slot is equal or slightly greater than the depth of the main tool body so that the slot is able to accommodate therein the main tool body so that the lower jaw is able to slide up and down the length of the main tool body.

Preferably, the lower jaw has a band receiving portion adapted to retain a portion of the band therein as the band is moved toward and been cut by the blade. Preferably, the band receiving portion is a tangential slot for accommodating and supporting the band.

Preferably, the tangential slot is V-shaped. Preferably, the fixed jaw releasably accommodates the cutting blade therein such that the cutting edge of the cutting blade extends downwardly from the fixed jaw whereby the cutting edge is aligned tangentially relative to the longitudinal axis of the main tool body so that the cutting blade cuts the band tangentially.

Preferably, the fixed jaw has fixed part attached to the main tool body and a releasably blade clamp part in between which the cutting blade is situated.

Preferably, the fixed part has an indentation therein configured and sized to accommodate the cutting blade therein such that the blade is securely held and unable to move vertically, horizontally or twist when the band cutter is use.

Preferably, the surface of the blade clamp part in contact with the fixed part has a protrusion shaped and sized to the shape of the blade such that the protrusion pushes the blade into the indentation in the fixed part in order to securely hold and support the blade within the indentation.

Preferably, the guide has a hole there through to accommodate a spindle of the moving means that is attached at one end to the lower jaw.

Preferably, the hole and spindle are threaded to allow the spindle to rotate within the threaded hole of the guide so that as the moving means when activated causes the spindle to be wound in one direction to cause the lower jaw to move upwards and to be wound in the opposite direction to cause the lower jaw to move downwards.

Preferably, the moving means has a handle to assist in the winding of the spindle.

Preferably, the moving means has a motor to assist in the winding of the spindle.

Preferably, the motor is a hydraulic, pneumatic, servo, solenoid or electric motor.

Preferably, the spindle is adapted to move in a linear and non-rotational upward and downward movement.

Preferably, the spindle is moved by a motor.

Preferably, the motor is a hydraulic, pneumatic, servo, solenoid or electric motor.

Preferably, the blade has a width that is at least equal to the width of the band being cut.

Preferably, the cutting edge of the blade is presented at 90° relative to the band when cutting edge makes contact with the band.

Preferably, the cutting edge of the blade is presented at angle between 0° and 180° relative to the band when cutting edge makes contact with the band.

Preferably, the moving means has a quick release mechanism to allow the quick release of the clamping action once the band is cut. Any other aspects herein described.

BRIEF DESCRIPTION OF THE DRAWINGS

The invention will now be described, by way of example only, by reference to the accompanying drawings.

DESCRIPTION OF THE PREFERRED EMBODIMENT(S)

Figure 1:
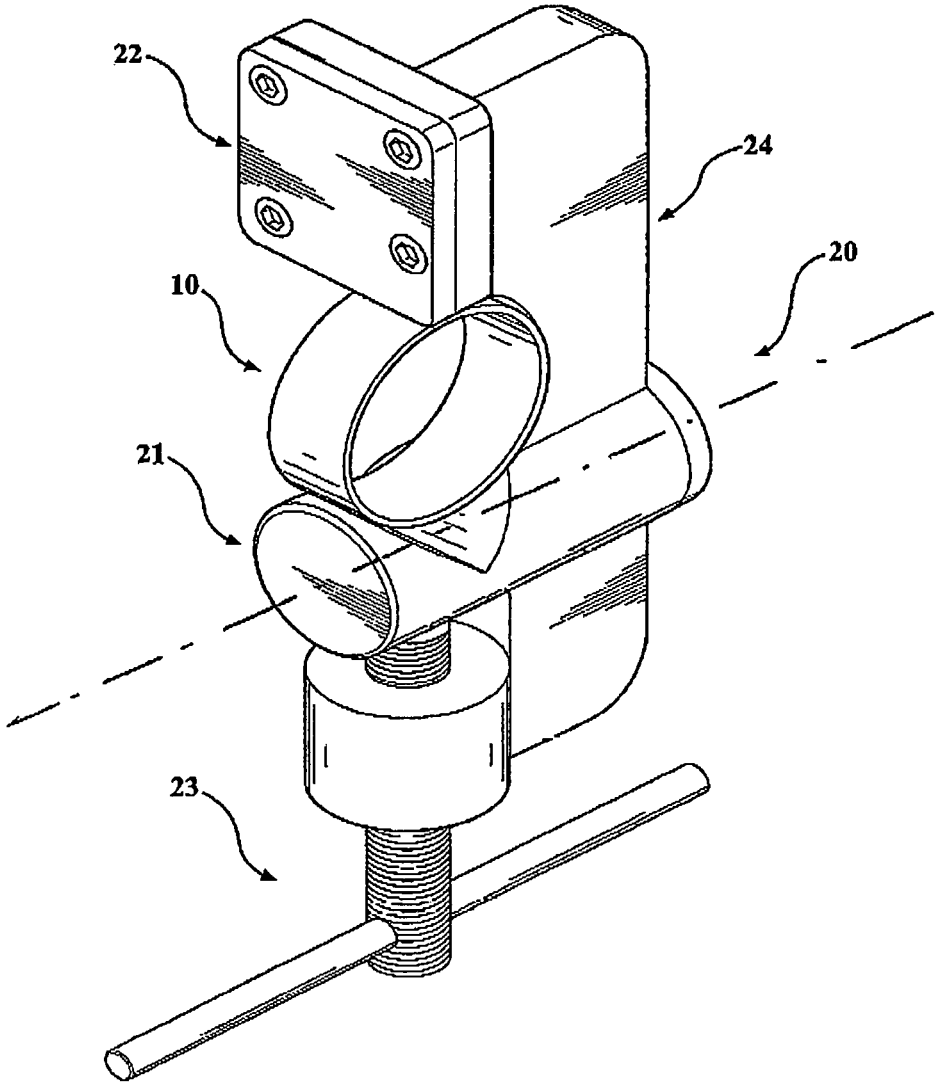
FIG. 1 is a perspective view of a band cutter in accordance with a first preferred embodiment of the invention.
Figure 2:
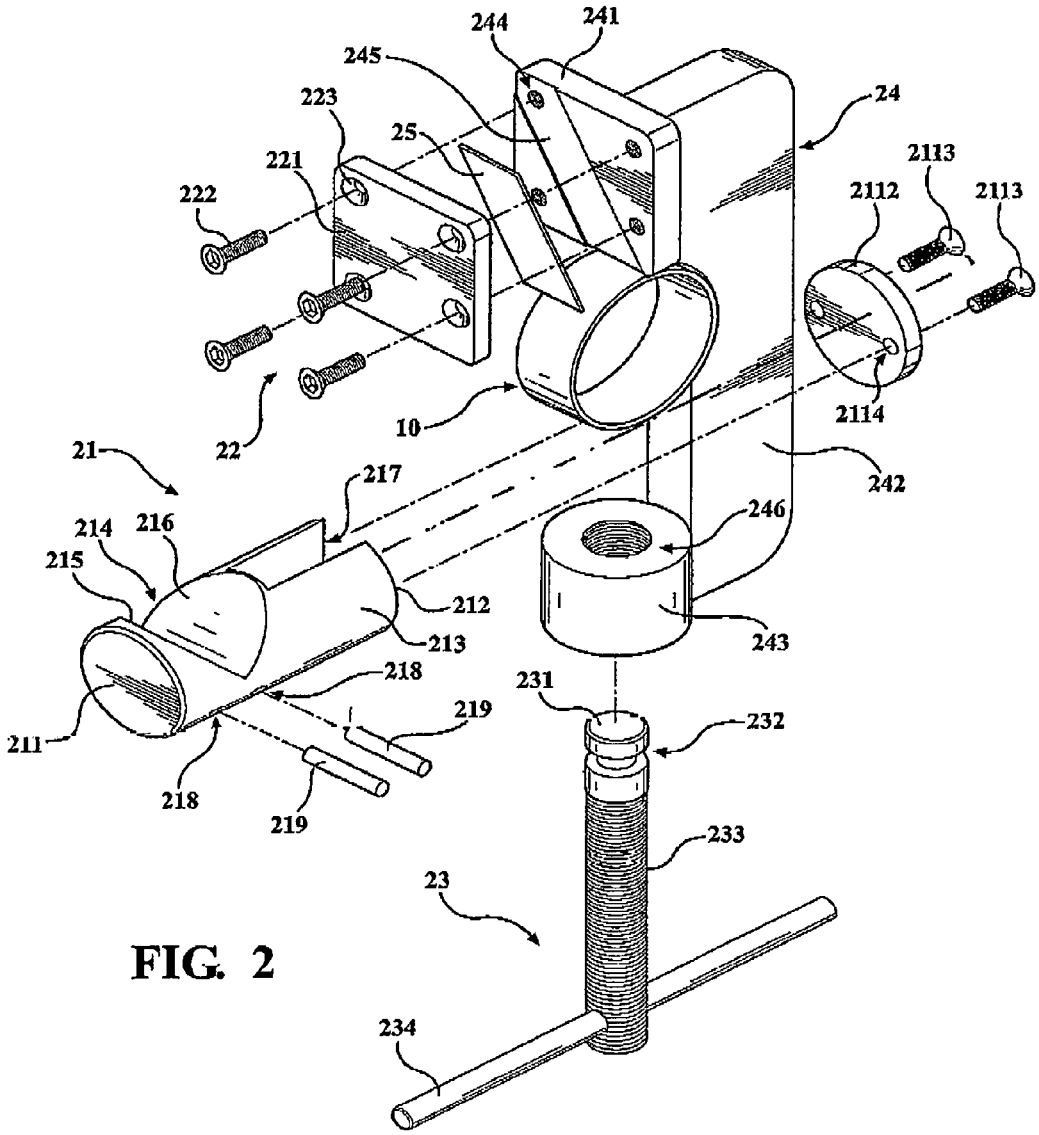
FIG. 2 is a perspective exploded view of the band cutter as shown in FIG. 1.

The following description will describe the invention in relation to preferred embodiments of the invention, namely a band for removing bands or rings from tubing joints such as those on and associated with plumbing fittings, in particular where the band or ring has been used to secure plastic plumbing pipe or tubing over a fitting.

The invention is in no way limited to these preferred embodiments as they are purely to exemplify the invention only and that possible variations and modifications would be readily apparent without departing from the scope of the invention.

Note for ease of showing and describing the inventive features of the band cutter clearly, the drawings do not show an actual fitting only the band or ring which would be attached to a fitting. The band cutter 20 has a main tool body 24 having a fixed upper jaw 22, a guide 243 and moveable lower jaw 21 situated between the upper jaw and the guide 243. The upper jaw is situated at an upper portion of the main tool body 24 and the guide 243 is situated at a lower portion of the main body portion such that both the main body portion 24 upper jaw 22 and the guide 243 are configured and dimensioned to form a substantially c-shape (in cross-section). The moveable lower jaw 21 is able to slide up and down the main body 24 and within the opening of the c-shape toward and away from the upper jaw 22 so as to releasably clamp a band between the two jaws 21, 22.

As shown in the drawings the lower jaw 21 is attached and able to slide along the vertical portion 242 of the main body 24 between the upper jaw 22 and the guide 243. The lower jaw 21 is shown as having a cylindrical body 213 with ends 211 & 212. A longitudinal slot 217 extends a distance in to the cylindrical body 213 from the end 212. The longitudinal slot 217 is dimensioned so that the depth of the slot 217 is slightly greater than the thickness of the vertical portion 242 and the depth of the slot 217 is equal or slightly greater than the depth of the vertical portion 242. An end cap 2112 is secured (by way of screws 2113 and holes 2114) to the end 212 of the cylindrical body 213 in order to slidingly retain the lower jaw to the main body 24. The cylindrical body 213 has on its upper surface a tangential slot 214 for accommodating and supporting the band 10. The tangential slot 214 is shown as having a V-shape with sides 215 & 216 which allows for different sized bands to be cut. It is envisaged that other shapes for the tangential slot 214 could be used. The lower part of the cylindrical body 213 beneath the tangential slot 214 has two pin receiving holes 218 to accommodate pins 219 used to retain an upper end 231 (via slot 232) of a spindle 233 with in a hole (not shown) in the bottom of the cylindrical body 213.

The upper jaw 22 consist of a fixed part 241 that includes an indentation 245 therein configured and sized to accommodate a cutting blade 25 therein such that the blade 25 is securely held and unable to move vertically, horizontally or twist when the band cutter 20 is use. The fixed part has screw receiving holes 244. A blade clamp 221 is removable secured to the fixed part by way of screws 222 passing through holes 223 in the blade clamp and into the screw receiving holes of the fixed part 241. The blade clamp 221 clamps the blade 25 to the fixed part 241. The surface of the blade clamp 221 in contact with the fixed part 241 can have a protrusion shaped and sized to the shape of the blade such that the protrusion (not shown) pushes the blade 25 into the indentation 245 in the fixed part 241 so that the blade 25 is securely held and supported within the indentation 245. The cutting edge of the blade 25 extends downwardly and outwardly from the lower edge of the fixed jaw 22 such that cutting edge of the blade 25 is able to contact and apply a cutting force to a band 10 when the band 10 is moved by the lower jaw 21 upwardly to the fixed jaw 22.

The guide 243 has a hole 246 there through to accommodate spindle 233 of a mechanism 23 for moving the lower jaw 21. The hole 246 is threaded to threadingly accommodate the spindle 233 which also threaded so that as the spindle wound by way of a handle 234 the lower jaw 21 is caused to move upward when wound in on direction and downward when wound in the opposite direction. As mentioned previously the upper part of the spindle is fixed to the lower jaw by way of pins 219 passing through slot 232 on the spindle. Whilst the drawings show a hand operated mechanism 23 it is envisaged that the handle could be removed 234 and the spindle attached to a hydraulic, pneumatic, servo, solenoid or electric motor.

In use a fitting with a band 10 is placed between the jaws 21, 22 of the band cutter 20 such that the band 10 is situated in the tangential slot 214 of the moveable jaw 21. In this position the band is ready for cutting by the blade 25 in the jaw 22. Jaw 21 is activated to move by winding the spindle 233 so that the fitting and band 10 is moved toward jaw 22 and the band pressed against the blade 25 until such time as the blade 25 tangentially cuts through the band 10. Once the band 10 is cut the moveable jaw 21 is caused to move away by winding the spindle in the opposite direction so as to allow fitting to be removed from the band cutter 20 and thus allow band 10 to be removed from the fitting.

Whilst the drawings show a threaded spindle 233 and threaded hole 246 in the guide 243 it is envisaged that both the spindle 233 and guide and hole 246 are not threaded such that the spindle can move linearly (without rotation) in order to vertically move the lower jaw 21 which is preferable when the band cutter is operated by either a hydraulic, pneumatic, servo, solenoid or electric motor.

The blade 25 has a width that is at least equal to the width of the band being cut. The cutting edge of the blade 25 is preferably at 90° to the band 10 when cutting edge makes contact with the band 10. It is envisaged that the blade 25 could be adapted to be at an angle relative to the band without departing from the scope of the invention.

The lower jaw mechanism 23 could include a quick release so that in order to release the clamping action once the band is cut the quick release is activated to allow the spindle and hence the lower jaw to move downwardly quickly. A band cutter that: is easy to use; is able to accommodate differing sized fittings and bands; is hand held and hand operated; uses replaceable blades; is able to be used in tight spaces or areas hard or difficult to get at, and is portable.

The Invention may also broadly be said to consist in the parts, elements and features referred or indicated in the specification, individually or collectively, and any or all combinations of any of two or more parts, elements, members or features and where specific integers are mentioned herein which have known equivalents such equivalents are deemed to be incorporated herein as if individually set forth. The examples and the particular proportions set forth are intended to be illustrative only and are thus non-limiting.

The invention has been described with particular reference to certain embodiments thereof. It will be understood that various modifications can be made to the above-mentioned embodiment without departing from the ambit of the invention. The skilled reader will also understand the concept of what is meant by purposive construction. It will also be understood that where a product, method or process as herein described or claimed and that is sold incomplete, as individual components or steps, or as a "Kit of Parts", that such exploitation will fall within the ambit of this invention even though there may not be any claim to a kit of parts included in the following claims.

The invention claimed is:

1. A band cutter for removing bands or rings from tubing joints associated with plumbing fittings, where the band or ring has been used to secure plastic plumbing pipe or tubing over a fitting, the plastic plumbing pipe or tubing extending along a longitudinal axis, the band cutter comprising:

a main tool body defining an upper portion and a lower portion, a fixed jaw situated on the upper portion of the main tool body, a moveable lower jaw independently slidably attachable to the main tool body and situated below the fixed jaw and above the lower portion, the lower jaw slidably attached to the main tool body between the upper and lower portions such that the lower jaw is adapted to independently slide along the main body situated between the upper and lower portions of the main tool body, the lower jaw has a band receiving portion therein adapted to retain a portion of the band thereon as the band is moved toward and been cut by a cutting blade, the cutting blade extending parallel to the longitudinal axis of the pipe when a cutting edge of the cutting blade makes contact with the band, a moving mechanism adapted to move the lower jaw toward and away from the fixed jaw, and the cutting blade situated within and extending from the fixed jaw in a direction toward the lower jaw, wherein the band cutter is adapted to clamp the band of the banded fitting between the fixed jaw and the lower jaw as the lower jaw is moved by the moving mechanism toward the fixed jaw so that as the fitting and the band are moved toward the fixed jaw, the band is pressed against the cutting blade until such time as the cutting blade tangentially cuts through the band and then once the band is cut the moveable lower jaw is caused to move away from the fixed jaw by the moving mechanism so as to allow fitting to be removed from the band cutter and thus allow the cut band to be removed from the fitting;

a guide situated at the lower portion of the main tool body directly opposite and spaced apart to the fixed jaw such that the main tool body, the fixed jaw and the guide form a substantially c-shape in cross-section;

the lower jaw being releasably attached to the main tool body and positioned such that the lower jaw is able to slide up and down the main tool body within an opening of the c-shape; and the lower jaw has a longitudinal slot dimensioned and sized so that the width of the slot is greater than the thickness of the main tool body and the depth of the slot is equal to or greater than the depth of the main tool body so that the slot is able to accommodate therein the main tool body, and the lower jaw is able to independently slide up and down the length of the main tool body.

2. The band cutter as set forth in claim 1, wherein the band receiving portion is a tangential slot for accommodating and supporting the band.

3. The band cutter as set forth in claim 2, wherein the tangential slot is V-shaped.

4. The band cutter as set forth in claim 1, wherein, the fixed jaw releasably accommodates the cutting blade therein such that a cutting edge of the cutting blade extends downwardly from the fixed jaw whereby the cutting edge is aligned tangentially relative to a longitudinal axis of the main tool body so that the cutting blade cuts the band tangentially.

5. The band cutter as set forth in claim 4, wherein the fixed jaw has a fixed part attached to the main tool body and a releasably blade clamp part in between which the cutting blade is situated.

6. The band cutter as set forth in claim 5, wherein the fixed part has an indentation therein configured and sized to accommodate the cutting blade therein such that the cutting blade is securely held and unable to move vertically, horizontally or twist when the band cutter is use.

7. The band cutter as set forth in claim 6, wherein the surface of the cutting blade clamp part in contact with the fixed part has a protrusion shaped and sized to the shape of the cutting blade such that the protrusion pushes the cutting blade into the indentation in the fixed part in order to securely hold and support the cutting blade within the indentation.

8. The band cutter as set forth in claim 1, wherein the guide has a hole there through to accommodate a spindle that is attached at one end to the lower jaw.

9. The band cutter as set forth in claim 8, wherein the hole and spindle are threaded to allow the spindle to rotate within the threaded hole of the guide so that as the moving mechanism when activated causes the spindle to be wound in one direction to cause the lower jaw to move upwards and to be wound in the opposite direction to cause the lower jaw to move downwards.

10. The band cutter as set forth in claim 9, wherein the moving mechanism has a handle to assist in the winding of the spindle.

11. The band cutter as set forth in claim 1, wherein the cutting blade has a width that is at least equal to the width of the band being cut.

12. The band cutter as set forth in claim 1, wherein the moving mechanism has a quick release mechanism to allow the quick release of the clamping action once the band is cut.

* * * * *